US007265732B2

(12) United States Patent
Lin

(10) Patent No.: US 7,265,732 B2
(45) Date of Patent: Sep. 4, 2007

(54) MICRO ADJUSTABLE ANTENNA BRACKET

(76) Inventor: Ming-Tien Lin, No. 206, Cheng Kung 3rd Road, Nan Kang Industrial Park, Nantou City (TW)

( * ) Notice: Subject to any disclaimer, the term of this patent is extended or adjusted under 35 U.S.C. 154(b) by 84 days.

(21) Appl. No.: 11/318,750

(22) Filed: Dec. 27, 2005

(65) Prior Publication Data

US 2007/0146229 A1 Jun. 28, 2007

(51) Int. Cl.
*H01Q 3/02* (2006.01)
*H01Q 1/12* (2006.01)
*H01Q 1/08* (2006.01)

(52) U.S. Cl. ..... 343/882; 343/878; 343/880

(58) Field of Classification Search ..... 343/880, 343/882, 890, 891, 878, 765, 757; 248/278.1, 248/514

See application file for complete search history.

(56) References Cited

U.S. PATENT DOCUMENTS 7,046,210 B1 * 5/2006 Brooker et al. ..... 343/880
7,113,144 B2 * 9/2006 Lin et al. ..... 343/880
7,142,168 B1 * 11/2006 Sinclair ..... 343/882
7,164,391 B2 * 1/2007 Lin et al. ..... 343/882

FOREIGN PATENT DOCUMENTS

FR 2824957 A1 * 11/2002
WO WO 2004109845 A1 * 12/2004

* cited by examiner

*Primary Examiner*—Hoang V. Nguyen
*Assistant Examiner*—Robert Karacsony
(74) *Attorney, Agent, or Firm*—William E. Pelton, Esq.; Cooper & Dunham LLP

(57) ABSTRACT

A micro adjustable antenna bracket has a stationary bracket having a compressible collar and a stationary panel, a driver mounted under the stationary panel, an antenna mounting bracket mounted pivotally on the stationary panel and multiple fasteners. The compressible collar has two mounting tabs, and the stationary panel is attached to the mounting tabs and has multiple connecting holes, a pivot hole, two wings and an elongated slot. The driver has a drive block, a drive shaft, an adjustment wheel and a connecting shaft. The drive shaft is mounted through the drive block, and the adjustment wheel is attached to the drive shaft. The antenna attachment bracket has an adjustable board, a pivot pin and a drive pin. The adjustable panel has multiple curved elongated through holes, and the fasteners are mounted through the connecting holes in the mounting tabs and the stationary panel and the curved elongated through holes.

2 Claims, 5 Drawing Sheets

MICRO ADJUSTABLE ANTENNA BRACKET

BACKGROUND OF THE INVENTION

1. Field of the Invention

The present invention relates to an adjustable antenna bracket, and more particularly to a micro adjustable antenna bracket to adjust a satellite antenna. The micro adjustable antenna bracket can adjust precisely the direction in which the antenna points to improve signal magnitude.

2. Description of Related Art

An antenna receives and transmits signals such as video, telephone and the like to and from a geosynchronous satellite.

Most antennas that transmit and receive signals to and from a satellite have a concave antenna dish with a rear surface and are generally mounted with an adjustable antenna bracket. The adjustable antenna bracket generally can adjust the direction in which the satellite antenna points.

Defects and shortcomings of the conventional adjustable antenna bracket follow.

1. The adjustable antenna bracket only roughly adjusts the angle of the satellite antenna.

2. The antenna dish cannot consistently be pointed precisely at the best location and angle. Therefore, the magnitude of the signal is not optimum.

SUMMARY OF THE INVENTION

The main objective of the present invention is to provide a micro adjustable antenna bracket that can precisely adjust the angle at which an antenna dish points.

A micro adjustable antenna bracket has a stationary bracket, a driver, an antenna attachment bracket and multiple fasteners. The stationary bracket has a compressible collar and a stationary panel. The compressible collar has two mounting tabs, and the stationary panel is attached to the mounting tabs and has multiple connecting holes, a pivot hole, two wings and an elongated slot. The driver is mounted under the stationary panel and has a drive block, a drive shaft, an adjustment wheel and a connecting shaft. The drive shaft is mounted through the drive block, and the adjustment wheel is attached to the drive shaft. The antenna attachment bracket is mounted pivotally on the stationary panel and has an adjustable board, a pivot pin and a drive pin. The adjustable panel has multiple curved elongated through holes, and the fasteners are mounted through the connecting holes in the mounting tabs, the connecting holes in the stationary panel and the curved elongated through holes in the adjustable panel.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
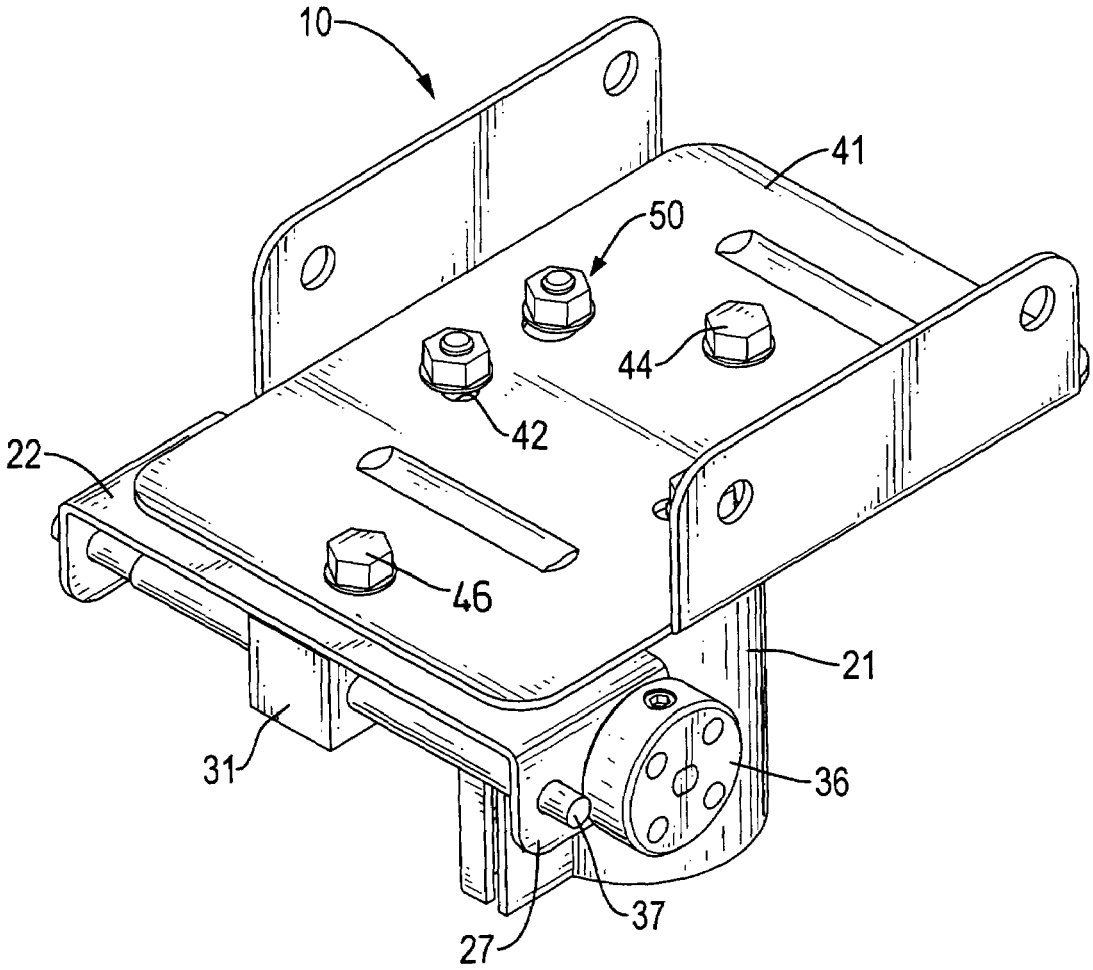
FIG. 1 is a perspective view of a micro adjustable antenna device bracket in accordance with the present invention.
Figure 2:
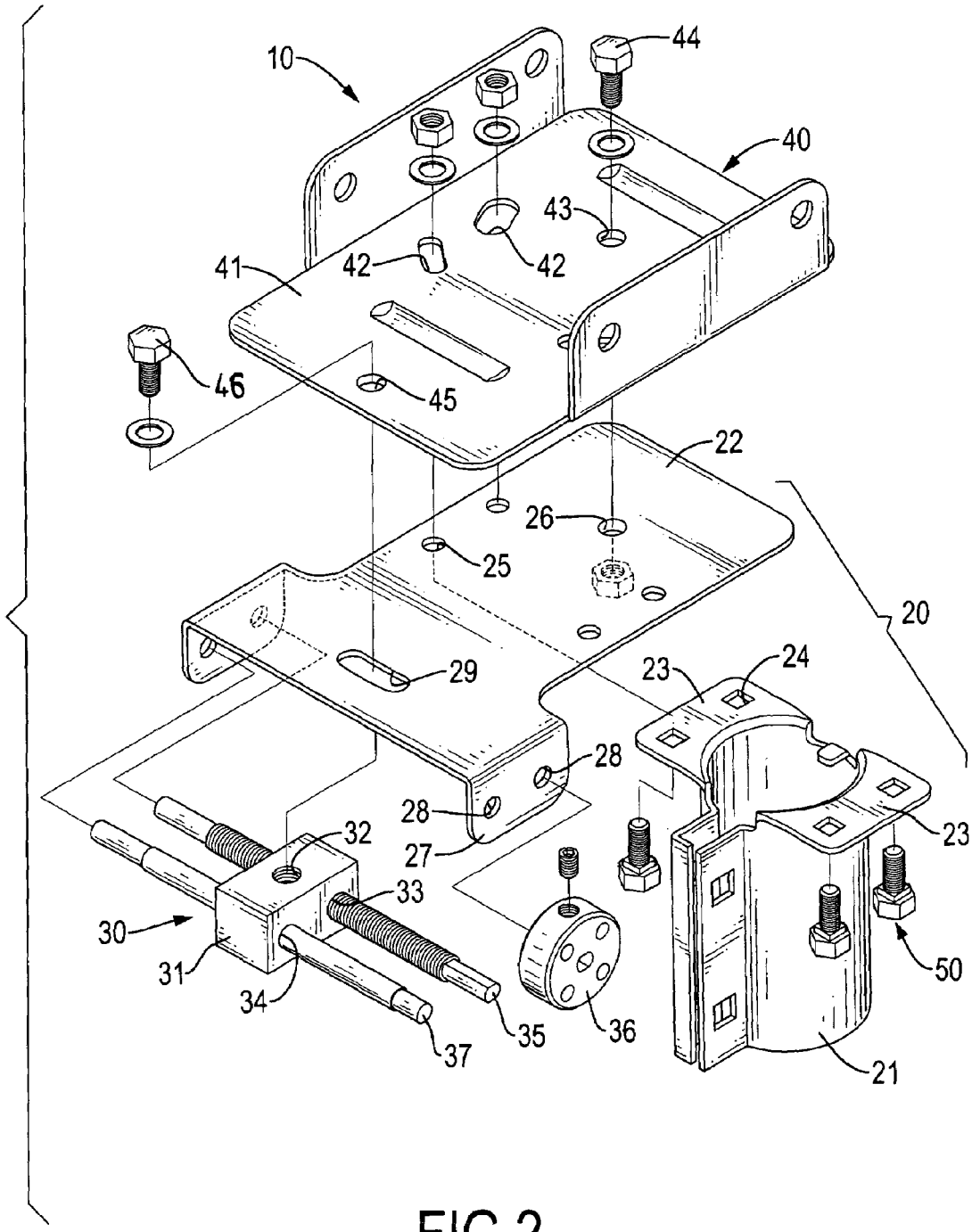
FIG. 2 is an exploded perspective view of the micro adjustable antenna bracket in FIG. 1.
Figure 3:
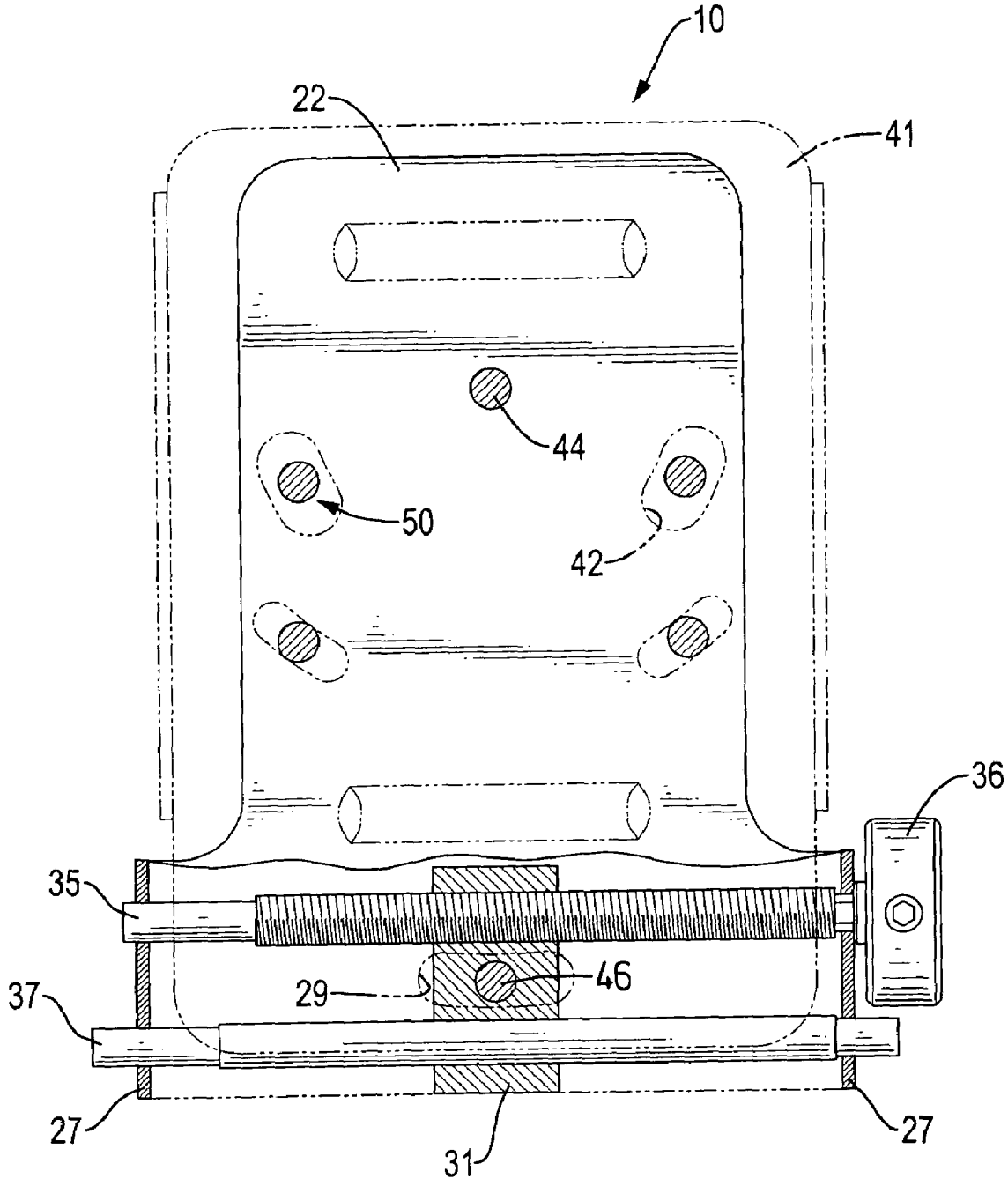
FIG. 3 is a top view in partial section of the micro adjustable antenna bracket in FIG. 1.

With reference to FIGS. 1, 2 and 3, a micro adjustable antenna bracket (10) in accordance with the present invention comprises a stationary bracket (20), a driver (30), an antenna attachment bracket (40) and multiple fasteners (50).

The stationary bracket (20) attaches to a post and provides a rough azimuthal adjustment and has a compressible collar (21) and a stationary panel (22).

The compressible collar (21) is a hollow, split tube, is mounted around and clamps onto a post and has a top, a bottom and two mounting tabs (23). The mounting tabs (23) are formed on and protrude radially out from the top of the compressible collar (21) opposite to each other, and each mounting tab (23) has multiple connecting holes (24). The connecting holes (24) are formed through the corresponding mounting tabs (23).

The stationary panel (22) is attached to the top of the compressible collar (21) and has a distal end, a proximal end, two side edges, multiple connecting holes (25), a pivot hole (26), two wings (27) and an elongated slot (29). The connecting holes (25) are formed through the stationary panel (22) and correspond respectively to the connecting holes (24) in the mounting tabs (23). The pivot hole (26) is formed through the stationary panel (22) between the connecting holes (25) near the distal end of the stationary panel (22). The wings (27) are formed respectively on and protrude down from the side edges of the stationary panel (22) at the proximal end of the stationary panel (22) and face each other. Each wing (27) has two through holes (28). The elongated slot (29) is formed through the stationary panel (22) between the wings (27) and has two ends.

The driver (30) is mounted between the wings (27) of the stationary panel (22) and has a drive block (31), a drive shaft (35), an adjustment wheel (36) and a connecting shaft (37).

The drive block (31) slidably abuts the elongated slot (29) in the stationary panel (22) and has a top, two sides, a threaded hole (32), a drive hole (33) and a mounting hole (34). The threaded hole (32) is formed in the top of the drive block (31) and the drive hole (33) is threaded and is formed through the drive block (31) between the two sides. The mounting hole (34) is formed through the drive block (31) between the two sides parallel to the drive hole (33).

The drive shaft (35) is threaded, is mounted rotatably through a pair of corresponding through holes (28) in opposite wings (27), screws through the drive hole (33) in the drive block (31), moves the drive block (31) toward a selected wing (27) when the drive shaft (35) is rotated and has a proximal end and a distal end. The adjustment wheel (36) is attached securely to the proximal end of the drive shaft (35) outside the corresponding wing (27) and rotates the drive shaft (35) when the adjustment wheel (36) is turned. The connecting shaft (37) is mounted slidably through the mounting hole (34) in the drive block (31) parallel to the drive shaft (35) and is mounted in the other two through holes (28) in the wings (27) to keep the drive block (31) from rotating with the drive shaft (35).

The antenna attachment bracket (40) is attached pivotally to the stationary panel (22), is attached securely to an antenna dish and has an adjustable panel (41), a pivot pin (44) and a drive pin (46).

The adjustable panel (41) is attached pivotally to the stationary panel (22) and has multiple curved elongated through holes (42), a pivot hole (43), and a drive hole (45). The curved elongated through holes (42) are formed through the adjustable panel (41) and correspond respectively to the connecting holes (25) through the stationary panel (22) and the connecting holes (24) in the mounting tabs (23) of the compressible collar (21). The pivot hole (43) is formed through the adjustable panel (41), and corresponds to the pivot hole (26) in the stationary panel (22). The drive hole (45) is formed through the adjustable panel (41) and communicates with the elongated slot (29) in the stationary panel (22) and the threaded hole (32) in the drive block (31).

The pivot pin (44) is mounted pivotally through the pivot hole (43) in the adjustable panel (41) and securely in the pivot hole (26) in the stationary panel (22) to allow the adjustable panel (41) to pivot relative to the stationary panel (22).

Figure 4:
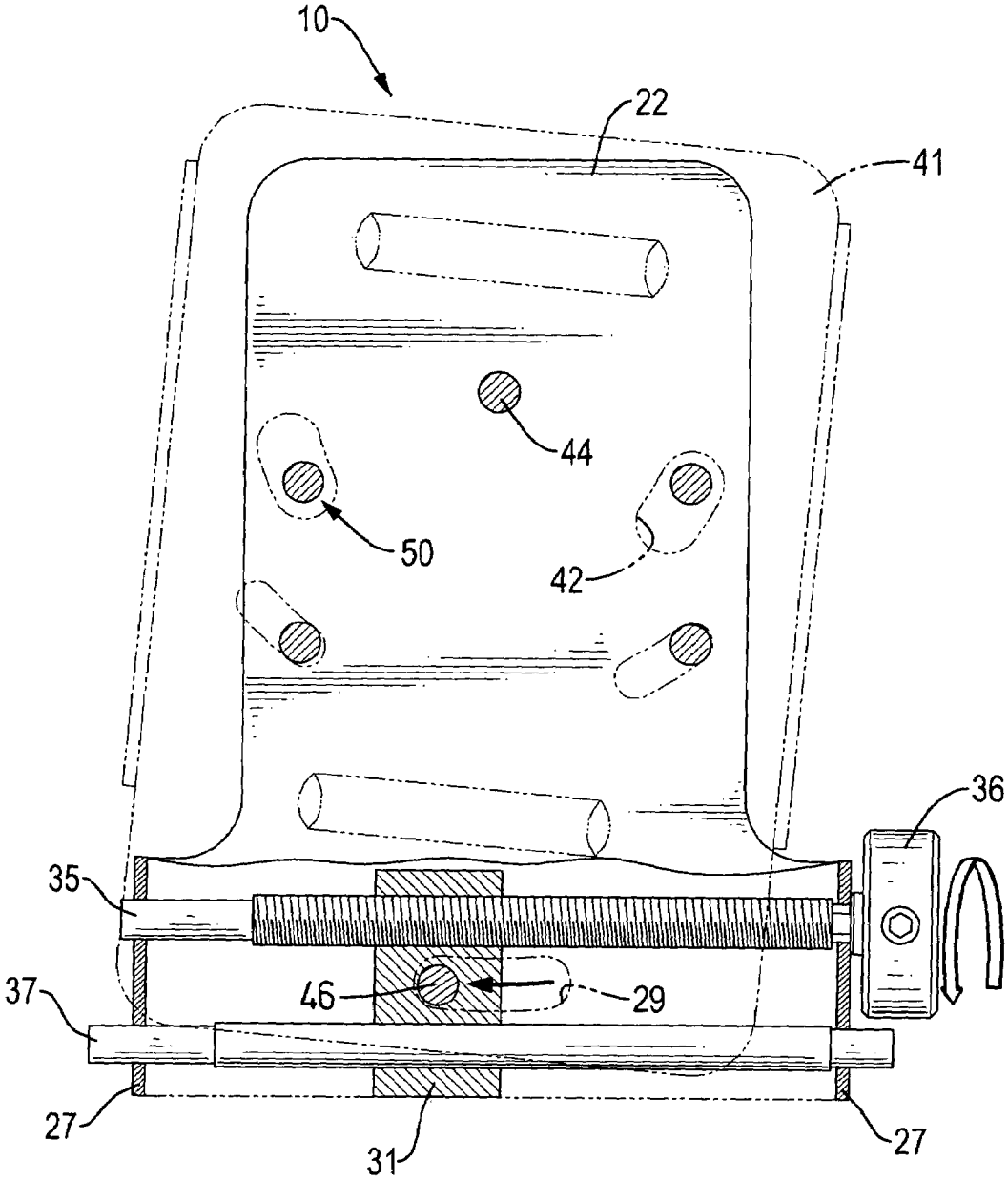
FIG. 4 is an operational top view in partial section of the micro adjustable antenna bracket in FIG. 1.
Figure 5:
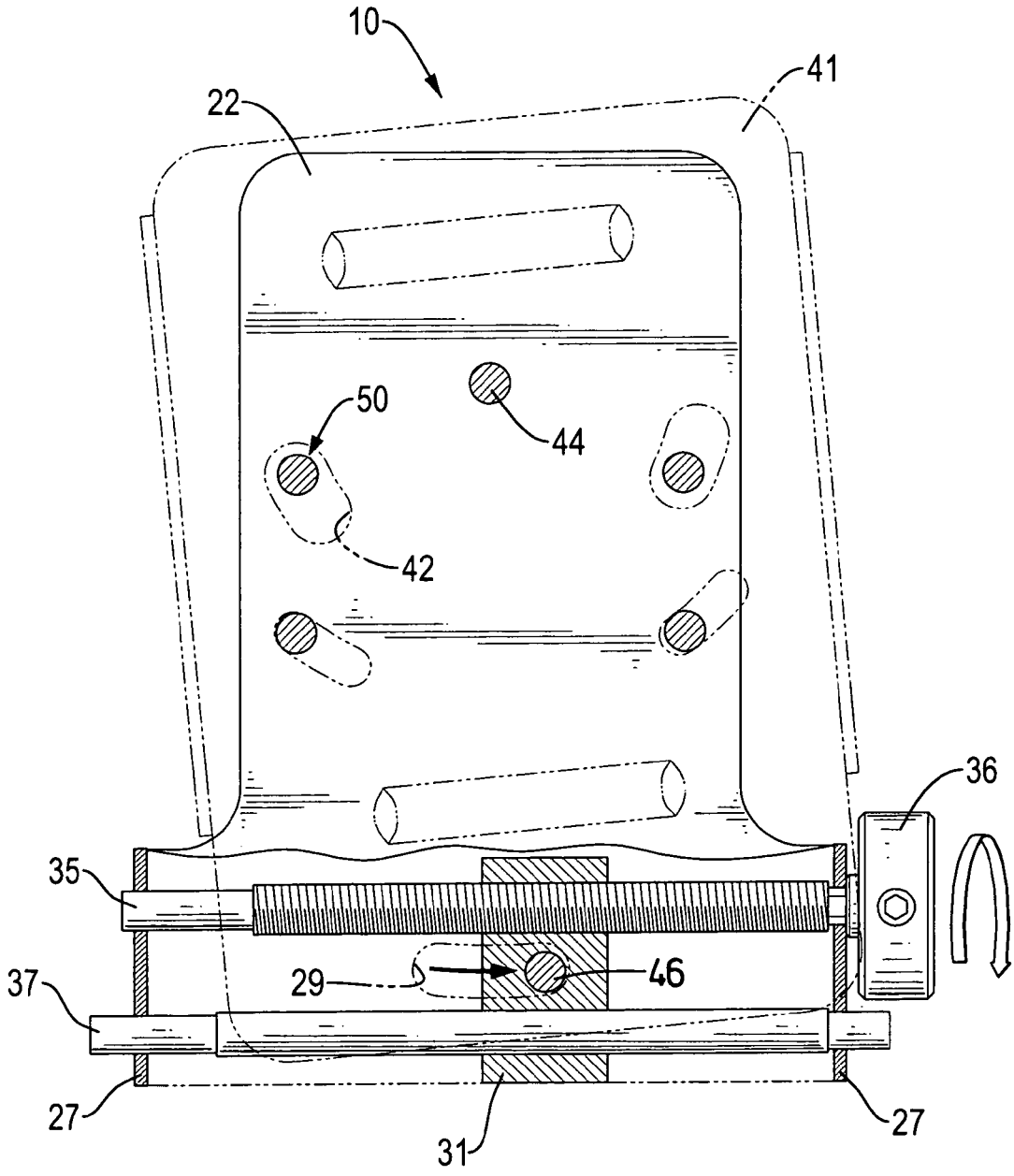
FIG. 5 is an operational top view in partial section of the micro adjustable antenna bracket in FIG. 1.

With further reference to FIGS. 4 and 5, the drive pin (46) is mounted through the drive hole (45) in the adjustable panel (41), slidably through the elongated slot (29) in the stationary panel (22) and securely in the threaded hole (32) in the drive block (31) to pivot the antenna attachment bracket (40) and an attached antenna when the adjustment wheel (36) is turned.

The fasteners (50) are mounted through the connecting holes (24) in the mounting tabs (23), the connecting holes (25) in the stationary panel (22) and the curved elongated through holes (42) in the adjustable panel (41) to hold the adjustable panel (41) securely in position after the adjustable panel (41) has been adjusted. Each fastener (50) may comprises a nut, a bolt and a washer.

With reference to FIGS. 4 and 5, when turning the adjustment wheel (36), and the drive block (31) will move along the adjusting shaft (35) and the connecting shaft (37) with the screwing with the drive shaft (35). Then, when the drive pin (46) is contacted with one of the ends of the elongated slot (29), and the drive pin (46) will push the adjustable panel (41) to rotate relative to the stationary panel (22) so as to adjust the angle of an antenna dish.

The micro adjustable antenna bracket (10) as described has the following advantages.

1. With rotating the adjustment wheel (36) to move the drive block (31) along the threaded adjusting shaft (35), the angle of the micro adjustable antenna bracket (10) is adjusted precisely by the drive block (31) to very small angles.

2. The antenna dish can be adjusted to the best position and angle by the micro adjustable antenna bracket (10) to optimize the signal received.

Even though numerous characteristics and advantages of the present utility model have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A micro adjustable antenna bracket having a stationary bracket for providing a rough azimuthal adjustment and having a compressible collar being a hollow split tube and having a top;

a bottom; and two mounting tabs formed on and protruding radially out from the top of the compressible collar opposite to each other, and each mounting tab having multiple connecting holes formed through the mounting tab; and a stationary panel attached to the top of the compressible collar and having a distal end;

a proximal end;

two side edges;

multiple connecting holes formed through the stationary panel and corresponding to the connecting holes in the mounting tabs;

a pivot hole formed through the stationary panel between the connecting holes near the distal end of the stationary panel;

two wings formed respectively on and protruding down from the side edges of the stationary panel at the proximal end of the stationary panel and facing each other, and each wing having two through holes; and an elongated slot formed through the stationary panel between the wings and having two ends;

a driver mounted between the wings of the stationary panel and having a drive block abutting the elongated slot in the stationary panel and having a top;

two sides;

a threaded hole formed in the top of the drive block;

a drive hole being threaded and formed through the drive block between the two sides; and a mounting hole formed through the drive block between the two sides parallel to the drive hole;

a drive shaft being threaded, mounted rotatably through a pair of corresponding through holes in the wings, screwing through the drive hole in the drive block for moving the drive block toward a selected wing when the drive shaft is rotated and having a proximal end; and a distal end;

an adjustment wheel attached securely to the proximal end of the drive shaft outside a corresponding wing for rotating the drive shaft when the adjustment wheel is turned; and a connecting shaft mounted slidably through the mounting hole in the drive block parallel to the drive shaft and mounted in the other two through holes in the wings; and an antenna attachment bracket attached pivotally to the stationary panel and having an adjustable panel attached pivotally to the stationary panel and having multiple curved elongated through holes formed through the adjustable panel and corresponding respectively to the connecting holes through the stationary panel and the connecting holes in the mounting tabs of the compressible collar;

a pivot hole formed through the adjustable panel and corresponding to the pivot hole in the stationary panel; and a drive hole formed through the adjustable panel and communicating with the elongated slot in the stationary panel and the threaded hole in the drive block;

a pivot pin mounted through the pivot hole in the adjustable panel and securely in the pivot hole in the stationary panel to allow the adjustable panel to pivot relative to the stationary panel; and a drive pin mounted through the drive hole in the adjustable panel, slidably through the elongated slot in the stationary panel and securely in the threaded hole in the drive block; and multiple fasteners mounted through the connecting holes in the mounting tabs, the connecting holes in the stationary panel and the curved elongated through holes in the adjustable panel to the hold the adjustable panel securely in position after the adjustable panel has been adjusted.

2. The micro adjustable antenna bracket as claimed in claim 1, wherein each fastener comprises a nut, a bolt and a washer.

* * * * *